US007819514B2

(12) United States Patent
Uezawa

(10) Patent No.: US 7,819,514 B2
(45) Date of Patent: Oct. 26, 2010

(54) LIQUID EJECTING APPARATUS AND LIQUID EJECTING HEAD

(75) Inventor: Haruhisa Uezawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 788 days.

(21) Appl. No.: 11/752,792

(22) Filed: May 23, 2007

(65) Prior Publication Data

US 2007/0273737 A1 Nov. 29, 2007

(30) Foreign Application Priority Data

May 24, 2006 (JP) ..... 2006-143739

(51) Int. Cl.
*B41J 2/19* (2006.01)
*B41J 2/175* (2006.01)

(52) U.S. Cl. ..... 347/92; 347/93

(58) Field of Classification Search ..... 347/65, 347/66, 86, 92, 93

See application file for complete search history.

(56) References Cited

U.S. PATENT DOCUMENTS

| | | | | |
|---|---|---|---|---|
| 5,495,272 | A * | 2/1996 | Yamaguchi | 347/28 |
| 6,244,698 | B1 * | 6/2001 | Chino et al. | 347/94 |
| 6,705,712 | B2 * | 3/2004 | Usui et al. | 347/86 |
| 6,749,296 | B2 * | 6/2004 | Usui et al. | 347/93 |

FOREIGN PATENT DOCUMENTS

| | | |
|---|---|---|
| CN | 1302732 A | 7/2001 |
| JP | 2000-211130 | 8/2000 |
| JP | 2003-039697 | 2/2003 |

* cited by examiner

*Primary Examiner*—Anh T. N. Vo
(74) *Attorney, Agent, or Firm*—Workman Nydegger

(57) ABSTRACT

A liquid ejecting apparatus includes a first flow path for supplying liquid, a second flow path that communicates with the first flow path, a filter disposed to face communication holes of the first and second flow paths, and an air bubble locking section that locks an air bubble in the communication hole of the second flow path at a time when the air bubble is discharged from the second flow path through the filter.

14 Claims, 8 Drawing Sheets

LIQUID EJECTING APPARATUS AND LIQUID EJECTING HEAD

BACKGROUND

1. Technical Field

The present invention relates to a liquid ejecting apparatus such as an inkjet-type recording device, a display manufacturing apparatus, an electrode forming apparatus, or a biochip manufacturing apparatus and a liquid ejecting head installed in the liquid ejecting apparatus.

2. Related Art

Ink jet printers as liquid ejecting apparatuses appropriate for paper printing are well known. Generally, ink jet printers have a configuration in which a liquid ejecting head having a fine nozzle for ejecting liquid (liquid droplets) is loaded on a carriage reciprocating with respect to printing paper. For example, in a liquid ejecting head disclosed in JP-A-2000-211130, an ink supply needle combined with an external ink cartridge for receiving ink, and a filter for trapping foreign bodies included in the ink is provided at one end of the ink supply needle.

Since the filter can trap air bubbles in the ink in addition to foreign bodies included in the ink, an air bubble generated on the front side of the filter continues to grow with time. In the case that the air bubble grows very large, the air bubble may pass through the filter relatively easily thereby causing inferior ejection, and accordingly, a so-called recovery operation that forcedly discharges the air bubble with the ink regularly or appropriately is required.

For the air bubbles' passing through the filter in the recovery operation, the air bubbles need to be close to the ink supply needle/filter, so that the air bubbles can block a predetermined region of the filter in the ink supply needle. In the case that the filter is not sufficiently blocked, the flowing ink easily passes through the filter, and accordingly, a sufficient pressure (discharge force) cannot be applied to the air bubbles.

However, it is difficult to maintain the above-described status for air bubbles that have been decreased in volume by over a specific amount due to the effect of the surface tension or buoyant force of the ink applied to a boundary face of the air bubbles. In other words, since a sufficient discharge-operation for air bubbles cannot be performed by the recovery operation, there is a problem that inferior discharge is caused or frequent recovery operations are required.

SUMMARY

An advantage of some aspects of the invention is that it provides a liquid ejecting apparatus and a liquid ejecting head which have a superior dischargeability of air bubbles.

According to a first aspect of the invention, there is provided a liquid ejecting apparatus including a first flow path for supplying liquid, a second flow path that communicates with the first flow path, a filter disposed to face communication holes of the first and second flow paths, and an air bubble locking section that locks an air bubble in the communication hole of the second flow path at a time when the air bubble is discharged from the second flow path through the filter.

In the liquid ejecting apparatus according to the first aspect of the invention, since air bubbles moved in the vicinity of the filter are locked in the outer peripheral portion of the communication hole of the second flow path at a time when the air bubbles are discharged from the second flow path through the filter, a status that the air bubbles are located to be in the proximity of the filter can be maintained to some degree.

Accordingly, air bubbles having relatively small volumes can easily pass through the filter, whereby an efficient operation of discharge of the air bubbles can be performed.

It is preferable that the air bubble locking section is a recessed section, formed in an outer peripheral portion of the communication hole of the second flow path, into which a portion of the air bubble can be made to enter.

It is more preferable that the recessed portion is formed as a gap between a face in which the communication hole of the second flow path is formed and the filter.

In this case, the above-described advantages can be efficiently acquired with a simple configuration.

In the liquid ejecting apparatus having the recessed portion formed as a gap between a face in which the communication hole of the second flow path is formed and the filter, it is preferable that the liquid ejecting apparatus further includes a spacer member for regulating a length of the gap.

The length of the gap between the face in which the communication hole of the second flow path is formed and the filter is closely related with the performance of the gap (recessed portion) as an air bubble locking section. Since the length of the gap is precisely regulated by the spacer member, the non-uniformity of the performance of the gap (recessed portion) as the air bubble locking section can be adjusted with a high precision.

It is preferable that the recessed section is prepared so as to be approximately symmetrical with respect to the center of the communication hole of the second flow path.

In this case, since the recessed section is prepared so as to be approximately symmetrical with respect to the center of the communication hole of the second flow path, the air bubble can be locked appropriately without inclining to one side of one of the recessed portions.

It is preferable that the recessed section is prepared so as to be discretely positioned.

While the recessed portion has a function for increase in the dischargeability of an air bubble by locking the air bubble, an air bubble that is inserted into the recessed portion cannot be discharged to the end, and accordingly, the recessed portion also has a function for increase of the amount of the remaining air bubble in the second flow path. In the liquid ejecting apparatus, since the recessed portion is prepared to be discretely positioned, the air bubbles can be efficiently locked at multiple points while excessive increase of the amount of the air bubble that cannot be discharged as described above is suppressed.

According to a second aspect of the invention, there is provided a liquid ejecting head including a first flow path for supplying liquid, a second flow path that communicates with the first flow path, a filter disposed to face communication holes of the first and second flow paths, and an air bubble locking section that locks an air bubble in the communication hole of the second flow path at a time when the air bubble are discharged from the second flow path through the filter.

In the liquid ejecting head according to the second aspect of the invention, since an air bubble moved in the vicinity of the filter is locked in the outer peripheral portion of the communication hole of the second flow path at a time when the air bubble is discharged from the second flow path through the filter, a status that the air bubble is located to be in the proximity of the filter can be maintained to some degree. Accordingly, air bubbles having relatively small volumes can easily pass through the filter, whereby an efficient operation of discharge of the air bubbles can be performed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the preferred embodiments of the present invention will be described in detail on the basis of the accompanying drawings.

Since the embodiments described below are concrete examples of the invention, various limits that are technically preferable are added, but the scope of the invention is not limited thereto unless there is an explicit description for limiting the scope of the invention. In the figures referred to in the following description, the vertical and horizontal scales of a member or a portion may be represented differently from actual scales for the convenience of description.

Configuration of Liquid Ejecting Apparatus

At first, the configuration of a liquid ejecting apparatus according to an embodiment of the invention will be described with reference to FIG. 1.

Figure 1:
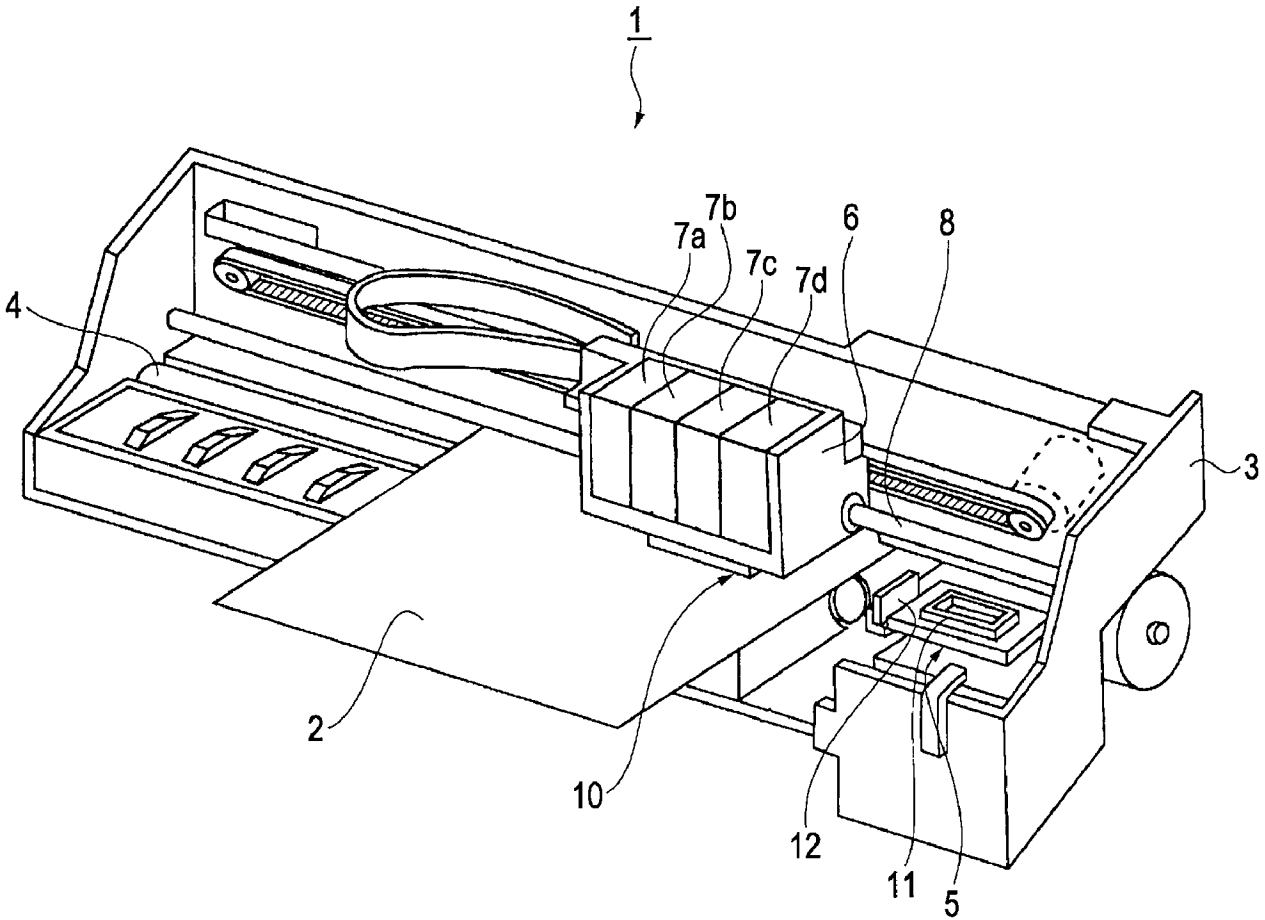
FIG. 1 is a schematic perspective view showing the whole configuration of a liquid ejecting apparatus according to an aspect of the present invention.

FIG. 1 is a schematic perspective view showing the whole configuration of the liquid ejecting apparatus.

In FIG. 1, a printer 1 as the liquid ejecting apparatus includes a guide frame 3 formed by a steel plate and the like, a transport roller 4 for transporting paper 2, a liquid ejecting head 10 having a fine nozzle on one side, and a maintenance section 5 for performing a maintenance operation for the nozzle of the liquid ejecting head 10. The liquid ejecting head 10 is loaded on a carriage 6 in the case that a nozzle forming face faces the paper 2 and is configured to reciprocate (scan) along a guide path 8. The guide frame 3 is a main component of the whole apparatus on the basis of the strength and weight thereof and serves as ground.

In the carriage 6, ink cartridges 7*a* to 7*d* for storing colored inks (inks) of four colors as liquids are loaded, and the colored inks of the colors are supplied to the liquid ejecting head 10. The ejection control for each nozzle of the liquid ejection head 10 is performed in synchronization with the scanning of the carriage 6 and the transport of the paper 2, and an image or the like is formed on the paper 2 with the ink ejected as ink droplets.

The maintenance section 5 includes a cap 11 that seals (capping) openings of nozzles by closely contacting the nozzle forming surface of the liquid ejecting head 10 and a wiper blade 12 that has the shape of a plate made of rubber or the like. The cap 11 is used for a so-called ink suction operation (recovering operation) of sucking ink from the nozzles by driving a communication pump (not shown) along with a function of protecting the nozzles. The wiper blade 12 is used for wiping ink attached to the nozzle forming surface.

Configuration of Liquid Ejecting Head

Figure 3:
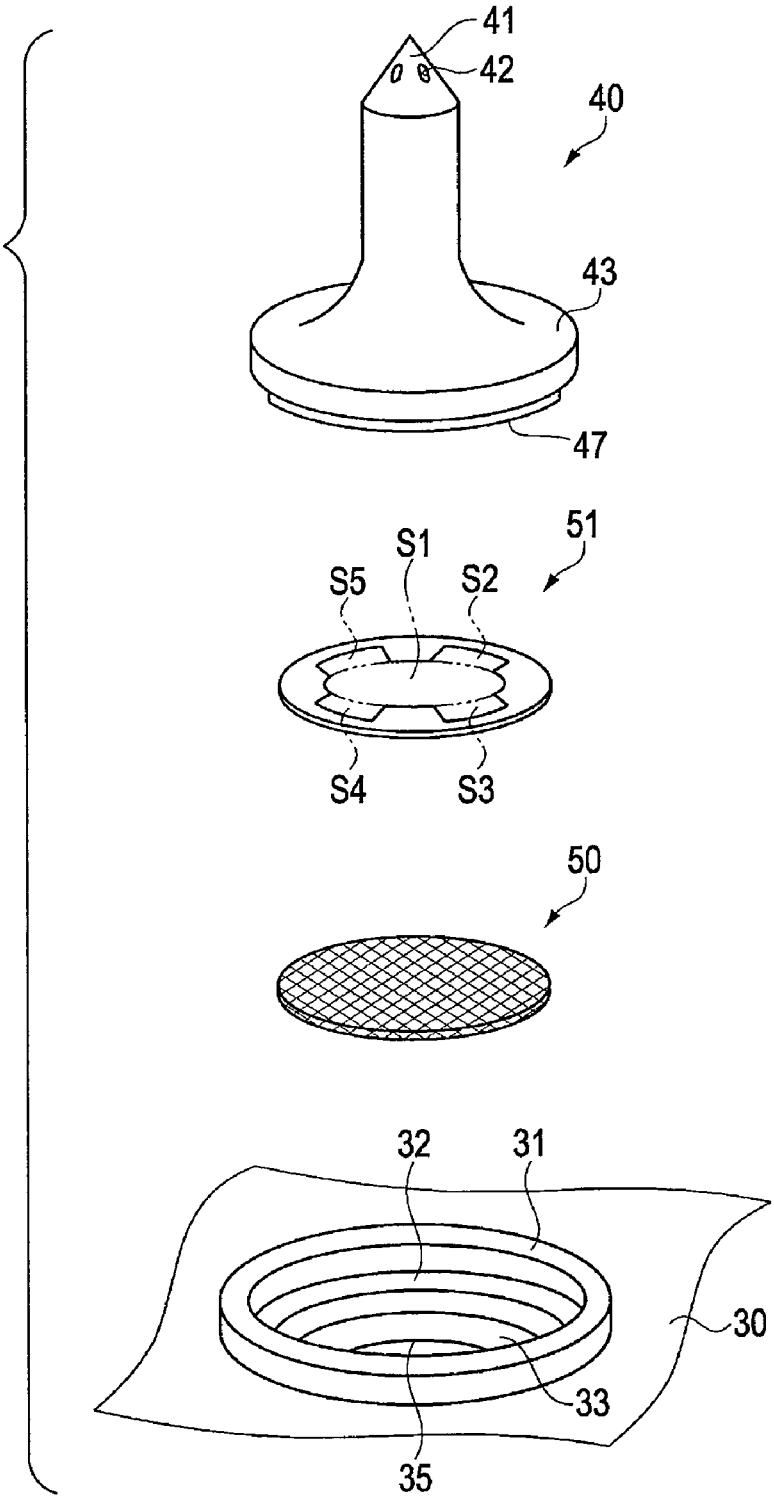
FIG. 3 is an exploded perspective view showing the structure in the vicinity of an ink introducing member according to an embodiment of the invention.
Figure 4:
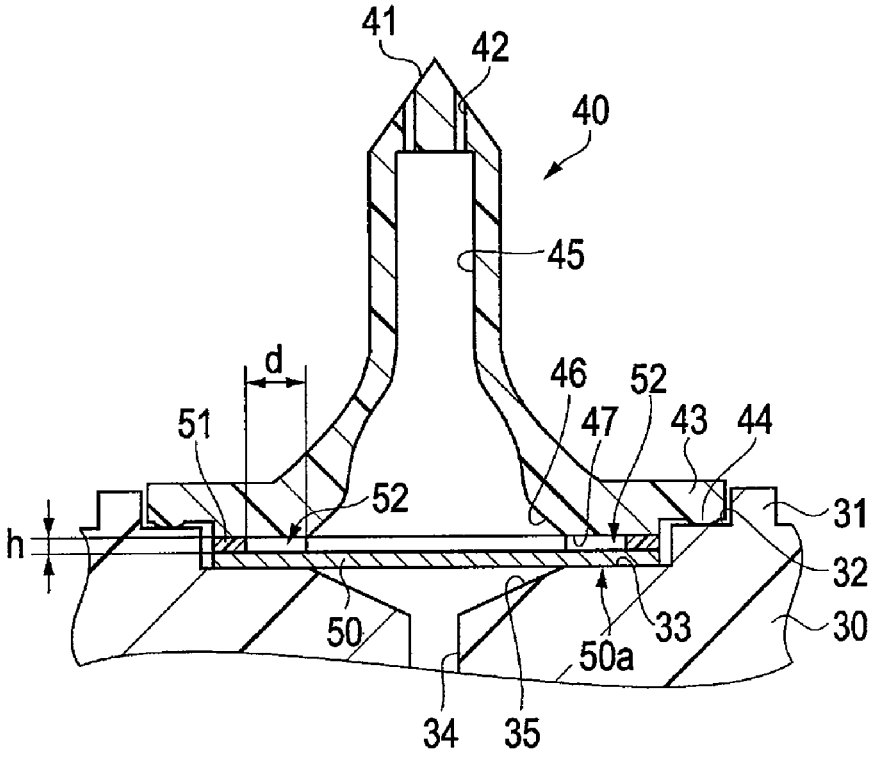
FIG. 4 is a section view showing the structure in the vicinity of an ink introducing member according to an embodiment of the invention.

Next, the configuration of the liquid ejecting head will be described with reference to FIGS. 2, 3 and 4.

Figure 2:
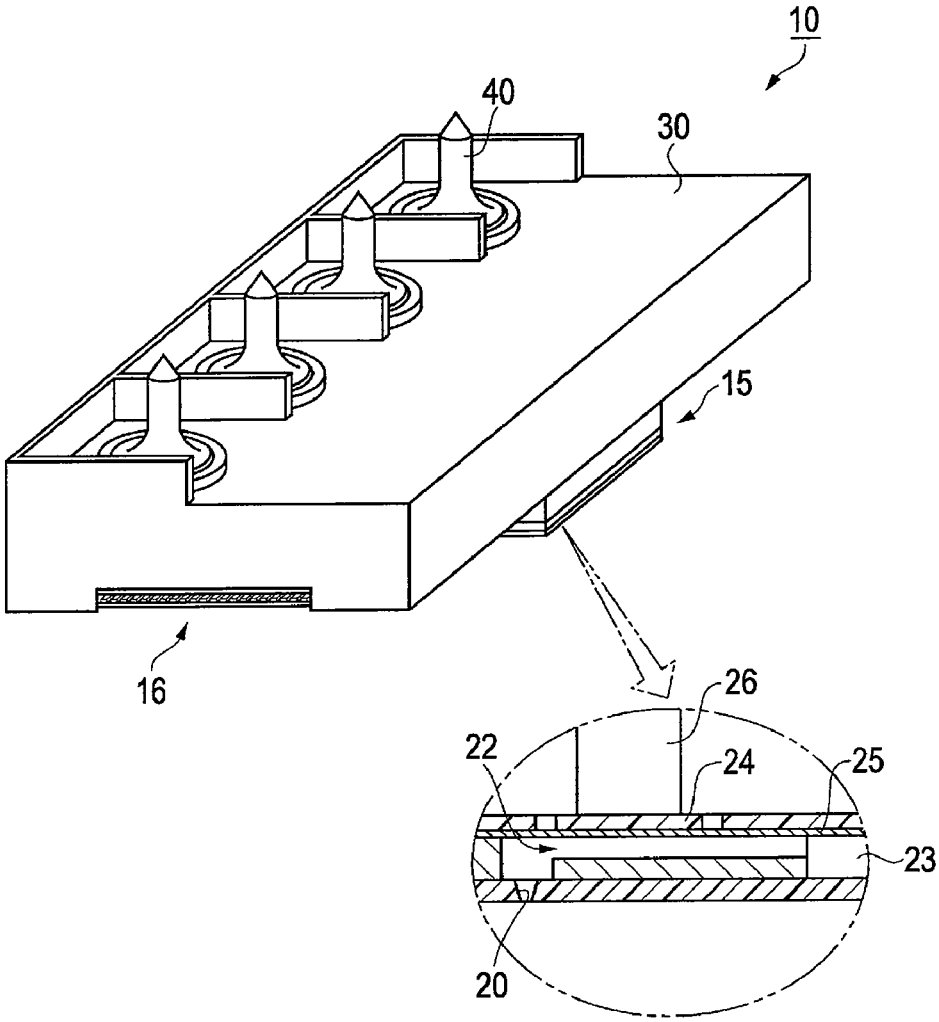
FIG. 2 is a diagram showing the whole configuration of a liquid ejecting head according to an embodiment of the invention.

FIG. 2 is a diagram showing the whole configuration of the liquid ejecting head. FIG. 3 is an exploded perspective view showing the structure in the vicinity of an ink introducing member. FIG. 4 is a section view showing the structure in the vicinity of the ink introducing member.

The liquid ejecting head 10 includes a case 30 in which a guiding rib or a recessed portion (partially omitted in drawing) is formed such that the ink cartridges 7*a* to 7*d* (See FIG. 1) can be mounted therein. Under the bottom of the case 30, an ejection section 15 for ejection of the ink and an electric circuit section 16 having a control circuit related with the ejection are provided.

The ejection section 15 includes nozzles 20 that are formed on one side in a predetermined arrangement, cavities 22 that communicate respectively with the nozzles 20, and reservoirs 23 that supply ink to the cavities 22 for each corresponding ink type. A top cover portion 24 of each cavity 22 is configured so as to be moved by a flexible membrane 25, and ink is ejected from the nozzles 20 by driving piezoelectric sensors 26 that are bonded to the top cover portions 24.

Ink introducing members 40 made of resins are bonded to the top face of the case 30 by using ultrasonic welding so as to be combined with supply sections of the ink cartridges 7*a* to 7*d*. Each of the ink introducing members 40 is a member in the shape of a hollow needle having an introduction hole 42 in its apex portion 41 and includes a flange portion 43 having a wide end on the side opposite to the apex portion 41. On the bottom surface of the flange portion 43, a welding protrusion 44 (in a pressed status due to welding in FIG. 4) is formed as an operation portion at a time when the ultrasonic welding process is performed.

Each of the ink introducing members 40 includes an introduction flow path 45 therein as a second flow path. The introduction flow path 45 has a flange portion 43 side wider than an apex portion 41 side, and the end of the wider side of the introduction flow path 45 is formed as a communication hole 46.

The case 30 includes a guide section 31 defining the peripheral face of the flange portion 43, a flange attaching face 32 for welding the flange portion 43, and a filter disposing face 33 for disposing the filter 50 in a spot for connecting to the ink introducing member 40. Inside the case 30, a supply path 34 as a first flow path for supplying ink to the ejection section 15 is formed. One end side of the supply flow path 34 is widened to face the filter disposing face 33 to be formed as a communication hole 35.

As a material for the case 30 and the ink introduction member 40, a resin such as PPE (Poly Phenylene Ether) that is appropriate for molding and welding, a mixed material in which a glass material is mixed with a resin, or the like is used.

The filter 50 is a member formed by weaving metal lines to form a mesh and the outer edge portion 50*a* of the filter is welded to the filter disposing face 33 so as to face the communication hole 46 and the communication hole 35. The filter 50 performs a function of trapping foreign bodies included in the ink that is supplied to the supply flow path 34 from the introduction flow path 45. The reason that the introduction flow path 45 and the supply flow path 34 on the filter 50 side are widened is for reducing the flow resistance (water head loss) of the ink passing though the filter by increasing the effective area of the filter 50.

A spacer member 51 which has an outer diameter approximately the same as that of the filter 50 and has a shape that of a center area S1 corresponding to the communication hole 35 and outer regions S2 to S5 thereof are cut away is disposed between the ink introduction member 40 and the filter 50. The spacer member 51 serves to regulate the length between the communication hole 46 forming face 47 and the filter 50 with a high precision. As a result, a recessed portion 52 having a height h and a depth d in a spot corresponding to the areas S2 to S5 of the spacer member 51 is formed in the outer edge portion of the communication hole 46. As shown in the figure, the recessed portion 52 corresponding to the areas S2 to S5 is formed symmetrically with respect to the center of the communication hole 46.

Discharge of Air Bubble

Next, discharge of an air bubble from an introduction flow path will be described with reference to FIGS. 5A to 5C and FIG. 6.

Figure 5A:
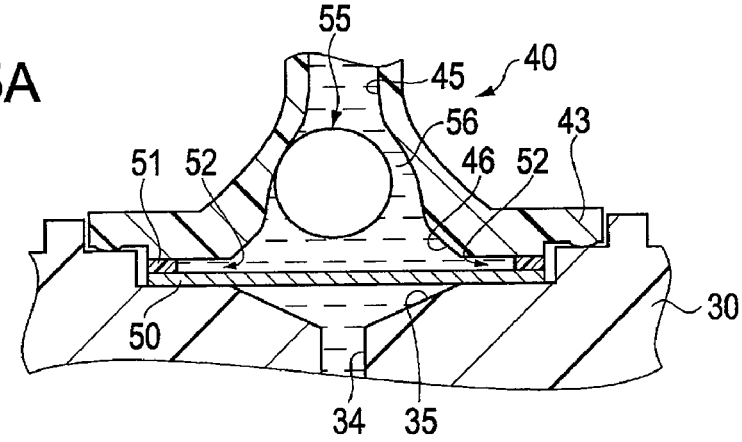
FIGS. 5A to 5C are diagrams showing a process of air bubble discharge from an introduction flow path according to an embodiment of the invention.
Figure 5B:
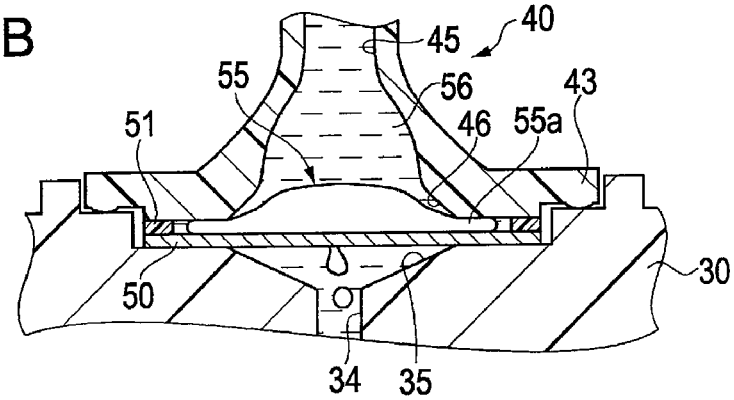
Figure 5C:
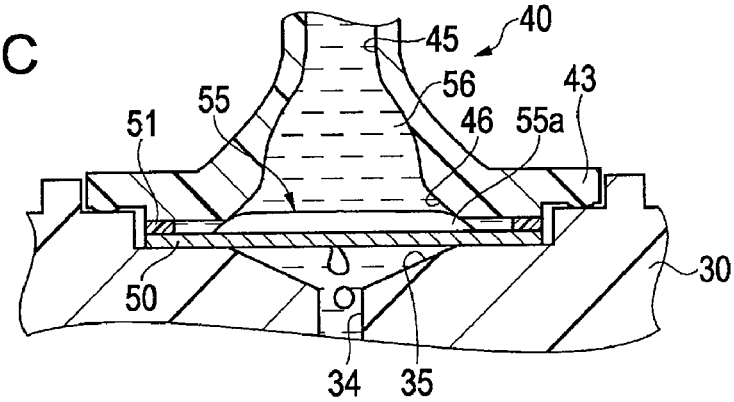
Figure 6:
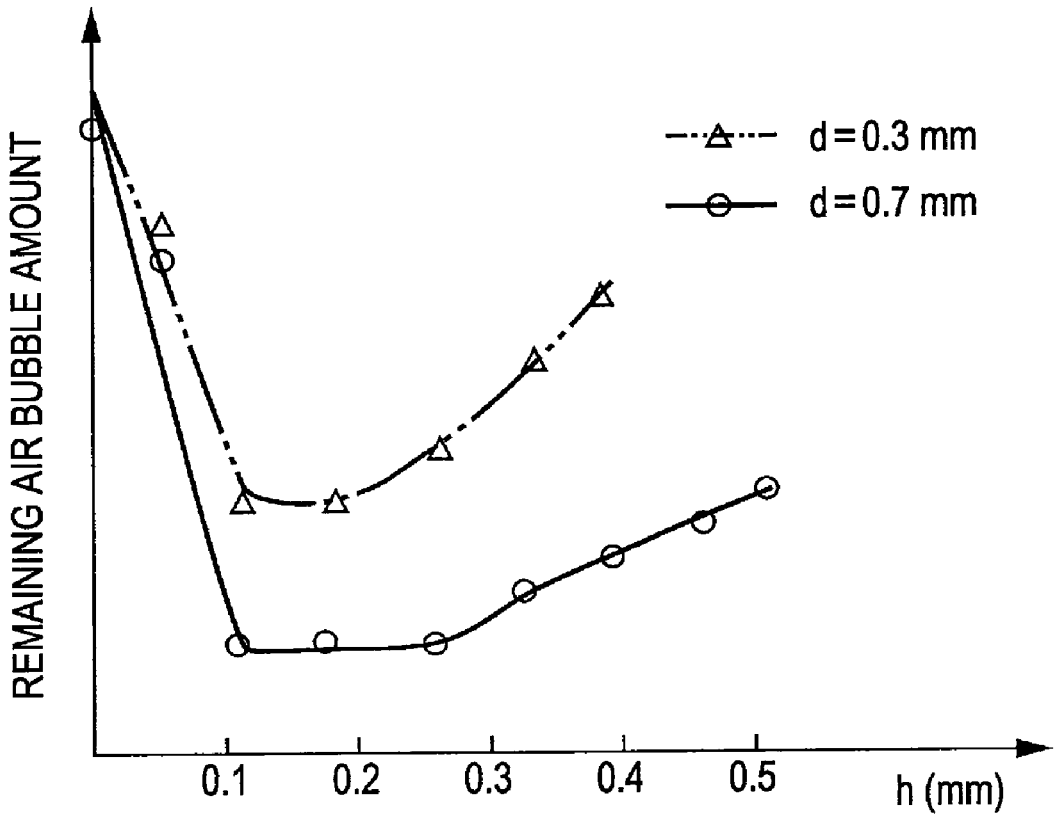
FIG. 6 shows relationship between a size and a remaining air bubble amount.

FIGS. 5A to 5C are diagrams showing a process of air bubble discharge from an introduction flow path. FIG. 6 is a diagram showing the relationship between the size of the recessed portion and the amount of remaining air bubble.

As shown in FIG. 5A, in the case that an air bubble 55 is included in the ink 56 inside the introduction flow path 45, the air bubble 55 is in the shape of a sphere due to surface tension of the ink 56 applied to a boundary surface of the air bubble 55. In such a case, the printer 1 (See FIG. 1) performs an operation for forced discharge of the air bubble 55 using a suction operation of the cap 11 (See FIG. 1). In the case in which the air bubble 55 included in the ink is left unattended, the flow of the ink 56 is impeded due to the air bubble 55 during a printing operation, whereby inferior discharge of the ink may occur.

When the suction operation is started, ink 56 and the air bubble 55 which are located inside the introduction flow path 45 move toward the filter 50 due to the pressure difference between the supply flow path 34 and the introduction flow path 45, and, as shown in FIG. 5B, the air bubble 55 becomes in such a status that the air bubble 55 blocks the filter 50. The air bubble 55 is under pressure due to compression from the ink 56 inside the introduction flow path 45. Accordingly, the air bubble 55 is made to enter the recessed portion 52 of which an outer edge portion 55*a* is formed in the outer edge of the communication hole 46. A portion of the air bubble passes through the filter 50 and is discharged from the introduction flow path 45, whereby the size of the air bubble gradually decreases.

As the size of the air bubble 55 decreases, the pressing force of the ink 56 applied to the filter 50 decreases, and the air bubble tries to return to a spherical form away from the filter 50 due to the surface tension applied to the boundary surface between the ink 56 and the air bubble. However, at this moment, the outer edge portion 55*a* of the air bubble 55 that has been made to enter the recessed portion 52 serves as an anchor, whereby the air bubble 55 remains in a status shown in FIG. 5B. In other words, the recessed portion 52 locks the air bubble 55 so as to be in a status that the air bubble 55 is located near the filter 50 in the suction operation, so that the air bubble 55 can easily pass through the filter 50. The recessed portion 52 serves as an air bubble locking section according to an embodiment of the invention.

When the size of the air bubble 55 decreases so that the air bubble 55 is in a status shown in FIG. 5C finally, the outer edge portion 55*a* of the air bubble 55 that has been made to enter the recessed portion 52 almost loses its function as an anchor, and the air bubble 55 moves away from the filter 50 and its shape becomes that of a sphere. The remaining air bubble 55 cannot be discharged any more by the suction operation, and hereinafter, the amount of the remaining air bubble 55 will be referred to as a remaining air bubble amount.

FIG. 6 shows the relationship between the remaining air bubble amount and the height h (See FIG. 4) and depth d (See FIG. 4) of the recessed portion. As a detailed evaluation condition, the effective diameter (outer diameter of the communication hole 35) of the filter 50 is 7.2 mm, the material of the filter 50 is SUS, the material of the ink introducing member 40 is an acrylic resin, the viscosity of the ink is 3.4 m Pa·s (25° C.), the surface tension of the ink is 29 mN/m (25° C.), and the flow amount of ink per introduction flow path in the suction operation is 0.19 ml/s.

As shown in FIG. 6, when the height h of the recessed portion 52 is over 0.1 mm, the remaining air bubble amount markedly decreases. In other words, the liquid ejecting head according to an embodiment of the invention having a gap (recessed portion 52) into which a portion of the air bubble can enter has a small remaining air bubble amount and a superior air bubble dischargeability, compared with a general liquid ejecting head that does not include a gap (recessed portion 52) between the forming face of the communication hole 46 and the filter 50.

Referring to FIG. 6, at a height h larger than 0.1 mm, as the height h increases or the depth d decreases, the remaining air bubble amount tends to increase. It is assumed the reason for this is that the locking function (anchor function) for making the air bubble 55 enter the recessed portion and maintaining the air bubble is weakened in the recessed portion 52 having a large height h or a small depth d.

In consideration of performing the locking function (anchor function) realized by making an outer edge portion 55 of the air bubble 55 enter the recessed portion, it is preferable that the recessed portion 52 is designed with an appropriate form and size on the basis of physical properties of the surfaces of ink or the ink introducing member or the like.

While the recessed portion 52 has a function of increasing the air bubble dischargeability by locking the air bubble 55, the recessed portion 52 also has a function of increasing the remaining air bubble amount since the air bubble 55 in the recessed portion 52 cannot be discharged to the end. Accordingly, the recessed portion 52 is not required to be arranged over a wide area, and it is preferable that the disposition position of the recessed portion and the like should be appropriately determined. In this embodiment, by arranging the recessed portion 52 to be symmetrical and symmetrical with respect to the center of the communication hole 46, the air bubble 55 can be locked at multiple points without inclining to one side.

Modified Example 1

Next, Modified Example 1 will be described with focusing on difference from the above described embodiment, with reference to FIG. 7.

Figure 7:
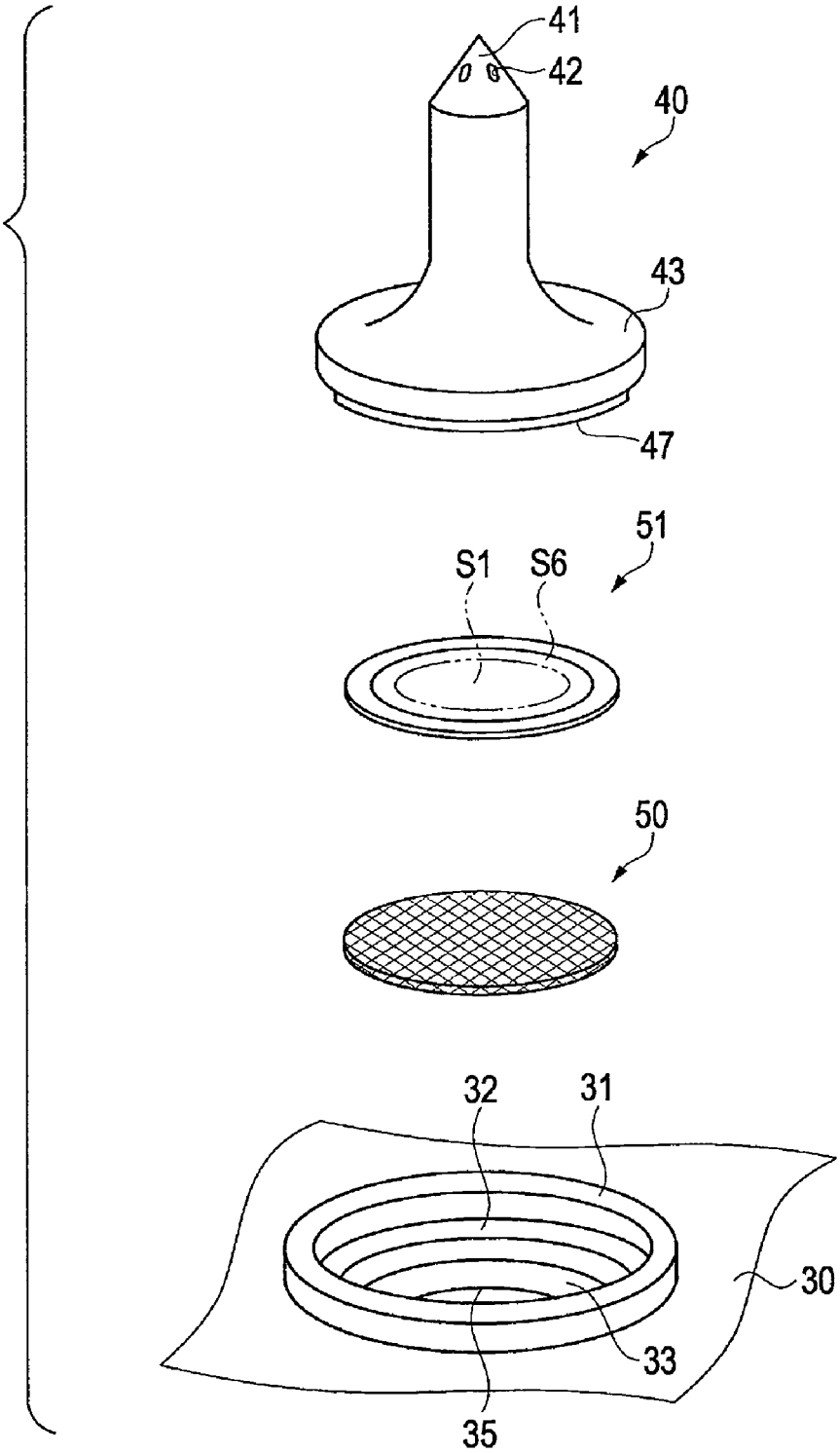
FIG. 7 is an exploded perspective view showing the structure in the vicinity of an ink introducing member according to Modified Example 1.

FIG. 7 is an exploded perspective view showing a structure in the vicinity of an ink introducing member according to Modified Example 1.

A spacer member 51 according to Modified Example 1 is in the shape in which a center region S1 corresponding to the communication hole 35 and a region S6 surrounding the outer peripheral of the region S1 are cut out. Accordingly, in Modified Example 1, the recessed portion is continuously formed over the whole outer peripheral portion of the communication hole 46 (See FIG. 4) in a spot corresponding to the region S6 of the spacer member 51. As in Modified Example 1, a recessed portion according to an embodiment of the invention is not required to be formed discretely.

Modified Example 2

Next, Modified Example 2 will be described with focusing on difference from the above described embodiment, with reference to FIG. 8.

Figure 8:
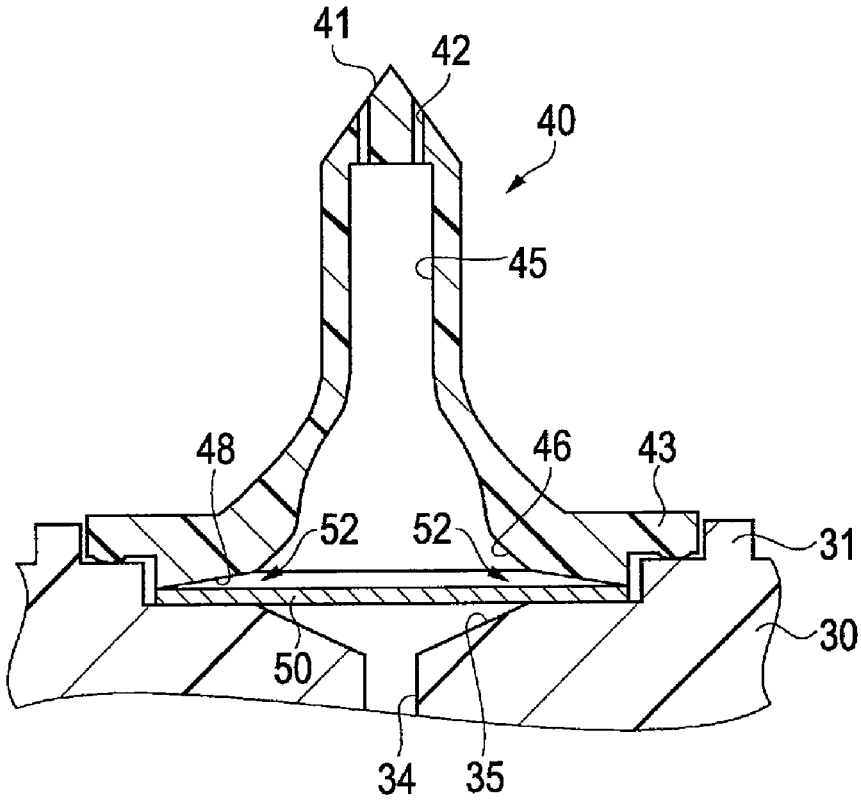
FIG. 8 is a section view showing the structure in the vicinity of an ink introducing member according to Modified Example 2.

FIG. 8 is a section view showing a structure in the vicinity of an ink introducing member according to Modified Example 2.

The ink introducing member 40 according to Modified Example 2 has a taper portion 48 formed thin in the outer peripheral portion of the communication hole 46. A recessed portion 52 is formed between the taper portion 48 and the filter 50. As in Modified Example 2, the spacer member is not an essential component to an embodiment of the invention, and the recessed portion may not be a gap having a constant length.

The present invention is not limited to the above described embodiments.

For example, the introducing flow path 45 and the communication hole 46 or the supply flow path 34 and the communication hole 35 may be configured to be eccentric to each other, and profiles of the introducing flow path 45 and the supply flow path 34 are not limited to the above described embodiments.

In addition, the present invention may be applied to a case where a filter is disposed in a supply section of a so-called open-carriage-type liquid ejecting apparatus.

In addition, the configurations in the embodiments of the invention may be combined, omitted, or combined with another configuration that is not shown in the figures appropriately.

What is claimed is:

1. A liquid ejecting apparatus comprising:

a first flow path for supplying liquid;

a second flow path that communicates with the first flow path;

a filter disposed to face communication holes of the first and second flow paths; and an air bubble locking section comprising a spacer member disposed between the communication hole of the second flow path and the filter that locks an air bubble in the communication hole of the second flow path at a time when the air bubble is discharged from the second flow path through the filter, the spacer member having a height of less than 0.1 mm.

2. The liquid ejecting apparatus according to claim 1, wherein the air bubble locking section is a recessed section, formed in an outer peripheral portion of the communication hole of the second flow path, into which a portion of the air bubble can be made to enter.

3. The liquid ejecting apparatus according to claim 2, wherein the recessed portion is formed as a gap between a face in which the communication hole of the second flow path is formed and the filter.

4. The liquid ejecting apparatus according to claim 3, wherein the spacer member also regulates a length of the gap.

5. The liquid ejecting apparatus according to claim 2, wherein the recessed section is prepared so as to be approximately symmetrical with respect to the center of the communication hole of the second flow path.

6. The liquid ejecting apparatus according to claim 2, wherein the recessed section is prepared so as to be discretely positioned.

7. A liquid ejecting head comprising:

a first flow path for supplying liquid:

a second flow path that communicates with the first flow path;

a filter disposed to face communication holes of the first and second flow paths; and an air bubble locking section comprising a spacer member disposed between the communication hole of the second flow path and the filter and that locks an air bubble in the communication hole of the second flow path at a time when the air bubble is discharged from the second flow path through the filter, the spacer member having a height of less than 0.1 mm.

8. A liquid ejecting apparatus comprising:

a first flow path for supplying liquid;

a second flow path that communicates with the first flow path;

a filter disposed to face communication holes of the first and second flow paths; and an air bubble locking section comprising a spacer member disposed between the communication hole of the second flow path and the filter so as to be in contact with the filter and which that locks an air bubble in the communication hole of the second flow path at a time when the air bubble is discharged from the second flow path through the filter.

9. The liquid ejecting apparatus according to claim 8, wherein the air bubble locking section is a recessed section, formed in an outer peripheral portion of the communication hole of the second flow path, into which a portion of the air bubble can be made to enter.

10. The liquid ejecting apparatus according to claim 9, wherein the recessed portion is formed as a gap between a face in which the communication hole of the second flow path is formed and the filter.

11. The liquid ejecting apparatus according to claim 10 wherein the spacer member also regulates a length of the gap.

12. The liquid ejecting apparatus according to claim 9, wherein the recessed section is prepared so as to be approximately symmetrical with respect to the center of the communication hole of the second flow path.

13. The liquid ejecting apparatus according to claim 9, wherein the recessed section is prepared so as to be discretely positioned.

14. The liquid ejecting apparatus according to claim 9, wherein the first flow path, second flow path, filter, and air bubble locking section are disposed in a liquid ejecting head.

* * * * *